United States Patent [19]

Shiao

[11] 4,138,265

[45] Feb. 6, 1979

[54] ANTIFOGGANTS IN CERTAIN PHOTOGRAPHIC AND PHOTOTHERMOGRAPHIC MATERIALS THAT INCLUDE SILVER SALTS OF 3-AMINO-1,2,4-MERCAPTOTRIAZOLE

[75] Inventor: Daniel D. Shiao, Victor, N.Y.

[73] Assignee: Eastman Kodak Company, Rochester, N.Y.

[21] Appl. No.: 810,141

[22] Filed: Jun. 27, 1977

[51] Int. Cl.[2] ..... G03C 1/02; G03C 5/24; G03C 5/30; G03C 1/34

[52] U.S. Cl. ..... 96/114.1; 96/48 HD; 96/66 T; 96/109

[58] Field of Search ..... 96/114.1, 77, 109, 95, 96/76, 54, 48 HD, 66 T

[56] References Cited

U.S. PATENT DOCUMENTS

| | | | |
|---|---|---|---|
| 2,824,001 | 2/1958 | Allen et al. | 96/109 |
| 3,220,839 | 11/1965 | Herz et al. | 96/109 |
| 3,312,550 | 4/1967 | Stewart et al. | 96/95 |
| 3,418,131 | 12/1968 | Bigelow | 96/109 |
| 3,598,598 | 8/1971 | Herz | 96/109 |
| 3,761,270 | 9/1973 | de Mauric et al. | 96/77 |
| 3,801,330 | 4/1974 | Brinckman et al. | 96/114.1 |
| 3,839,041 | 10/1974 | Hiller | 96/114.1 |
| 3,997,346 | 12/1976 | Masuda et al. | 96/114.1 |
| 4,003,749 | 1/1977 | Masuda et al. | 96/114.1 |

FOREIGN PATENT DOCUMENTS

| | | | |
|---|---|---|---|
| 2443292 | 3/1974 | Fed. Rep. of Germany | 96/114.1 |
| 2650764 | 5/1977 | Fed. Rep. of Germany | 96/114.1 |

OTHER PUBLICATIONS

Research Disclosure 4/74, p. 36, #12044, Offedah-l-Color Photothermographic Material.

Research Disclosure, 6/77, p. 80, #15869 – Knight et al.

*Primary Examiner*—J. Travis Brown

*Assistant Examiner*—L. Falasco

*Attorney, Agent, or Firm*—Richard E. Knapp

[57] ABSTRACT

A photographic material, especially a photothermographic material, for producing a dye-enhanced silver image comprising, in reactive association, (a) photosensitive silver halide, (b) an image-forming combination comprising (i) a silver salt of a certain 3-amino-1,2,4-mercaptotriazole derivative with (ii) a phenylenediamine or aminophenol silver halide developing agent, (c) a compound that contains a coupling moiety and which forms a dye upon reaction with the oxidized form of the developing agent, such as upon heating the element to a temperature above about 80° C., (d) a binder, and (e) an antifoggant concentration of a thiazoline thione antifoggant, provides developed dye-enhanced silver images without the need for processing solutions or baths and provides reduced fog upon processing. An image can be developed in this material by merely heating the material to moderately elevated temperatures. Other addenda employed in heat developable photographic materials, such as sensitizing dyes, can be employed with the photographic materials described.

44 Claims, No Drawings

ANTIFOGGANTS IN CERTAIN PHOTOGRAPHIC AND PHOTOTHERMOGRAPHIC MATERIALS THAT INCLUDE SILVER SALTS OF 3-AMINO-1,2,4-MERCAPTOTRIAZOLE

BACKGROUND OF THE INVENTION

1. Field of the Invention

This invention relates to heat developable imaging materials and processes for developing a dye-enhanced silver image employing in reactive association (a) photosensitive silver halide, (b) an image-forming combination comprising (i) a silver salt of a certain 1,2,4-mercaptotriazole derivative with (ii) a phenylenediamine or aminophenol silver halide developing agent, (c) a compound that contains a coupling moiety and which forms a dye upon reaction with the oxidized form of the developing agent, (d) a binder, and (e) an antifoggant concentration of a thiazoline thione antifoggant. In one of its aspects it relates to a photothermographic element comprising a support having thereon the described photosensitive silver halide and combination of imaging materials and an antifoggant concentration of the thiazoline thione antifoggant. In another of its aspects it relates to a photographic composition, especially a photothermographic composition, comprising the described photosensitive silver halide and imaging composition with the antifoggant concentration of the thiazoline thione antifoggant. A further aspect of the invention relates to a process of developing a dye-enhanced silver image in a photographic material, especially a photothermographic material, containing the described imaging combination and the thiazoline thione antifoggant.

2. Description of the State of the Art

It is known to provide an image in an imaging material, especially a photographic imaging material, by what is known as dry processing with heat. Such an imaging material is often described as a heat developable photographic material or photothermographic material. Such heat developable photographic materials after imagewise exposure are heated to moderately elevated temperatures to provide a developed image in the absence of a processing solution or bath. Typical heat developable imaging materials or photothermographic materials are described, for example, in U.S. Pat. No. 3,801,321 of Evans et al, issued Apr. 2, 1974; U.S. Pat. No. 3,152,904 or Sorensen et al, issued Oct. 13, 1964; U.S. Pat. No. 3,457,075 of Morgan et al, issued July 22, 1969; U.S. Pat. No. 3,392,020 of Yutzy et al, issued July 9, 1968; and British Specification No. 1,161,777 published Aug. 20, 1969.

The most commonly used silver salts in such heat developable photographic materials, especially photothermographic materials, are silver salts of long-chain fatty acids, such as silver behenate, which generally require hydrophobic binders. It has been desirable to replace these silver salts of long-chain fatty acids to enable use of aqueous or other hydrophilic compositions which further enable the use of conventional silver halide emulsion technology in heat developable photographic materials. Use of silver behenate as a source of silver in heat developable materials is not particularly compatible with aqueous formulations of photosensitive silver halide materials. Other silver salts or complexes have been proposed for such heat developable photographic materials. These include, for example, silver salts of benzotriazole, saccharin and related silver salts or complexes. These are described, for example, in heat developable photographic materials in U.S. Pat. No. 3,617,289 of Ohkubo et al, issued Oct. 2, 1971; U.S. Pat. No. 3,666,477 of Goffe, issued May 30, 1972; U.S. Pat. No. 3,672,904 of deMauriac, issued June 27, 1972; U.S. Pat. No. 3,832,186 of Masuda et al, issued Aug. 27, 1974; British Specification No. 1,205,500 published Sept. 16, 1970; U.S. Pat. No. 3,689,270 of Anderson et al, issued Sept. 5, 1972; and *Research Disclosure,* Volume 150, Item 15026, October 1976, pages 18–21, published by Industrial Opportunities Ltd., Homewell, Havant Hampshire, PO9 1EF, UK. While many of these silver complexes or salts can provide an image in such heat developable photographic materials, they often provide less than desired processing temperature latitude, photographic speed, image tone, or a combination of one or more of these problems. The photographic materials also in some cases have required the presence of what has been described as a "melt-forming compound" to provide a desired developed image.

It is desired in many cases to spectrally sensitize heat developable photographic materials to enable exposure to other than the blue region of the visible spectrum. Difficulty is often encountered in spectrally sensitizing photosensitive silver halide to be used in heat developable materials. While in many cases some degree of spectral sensitization can be provided, it is often insufficient for many photographic purposes. It has been desirable to provide a heat developable silver halide photographic material which enables a dye-enhanced silver image and which is based on photographic silver halide technology which permits use of a broader range of spectral sensitizing dyes.

Silver salts of a variety of heterocyclic compounds are known for various purposes in photographic materials. Examples of such uses of silver salts are described in U.S. Pat. No. 2,353,754 of Peterson, issued July 18, 1944 and U.S. Pat. No. 3,794,496 of Manhart, issued Feb. 26, 1974.

A common problem encountered in heat developable photographic materials centers on instability of the image following processing. Often heat developable photographic materials have required addition of a separate post-processing image stabilizer or stabilizer precursor to provide desired post-processing stability. Examples of stabilizer precursors in photothermographic materials are described, for instance, in U.S. Pat. No. 3,839,041 of Hiller, issued Oct. 1, 1974. Dye enhancement of silver images in photographic materials, however, provides additional problems. One of the problems is undesired fog upon processing which is not answered by a stabilizer precursor that does not adequately release a stabilizing moiety within the desired time. No suitable answer to this undesired fog is found in the described art.

A photothermographic material has been described comprising in reactive association (a) photosensitive silver halide, (b) an image-forming combination comprising (b) an image-forming combination comprising (i) a silver salt of certain 1,2,4-mercaptotriazole derivatives with (ii) a silver halide developing agent, and (c) a polymeric binder. This photothermographic material is described in *Research Disclosure,* June 1977, pages 80–81, Item 15869, of P. D. Knight, R. A. deMauriac and P. A. Graham. An image in this material can be developed after imagewise exposure by merely heating the material to moderately elevated temperatures. However, it has been desirable to provide an additional imaging means in this photothermographic material.

The additional imaging material, however, can provide additional problems such as fogging problems in the imaging mechanism during development. No answer to this problem has been obtained from the art described.

It is also known to provide a dye image to enhance a silver image in a photographic material. This is described, for example, in U.S. Pat. No. 2,266,456 of Wilder, issued Dec. 16, 1941; British Specification No. 1,096,049 published Dec. 20, 1967; British Specification No. 614,808 accepted Dec. 23, 1948; U.S. Pat. No. 3,622,629 of Lugosy, issued Nov. 23, 1971; and British Specification No. 515,022 accepted Nov. 23, 1939. No answer to the problem of fog in a photographic material, especially a photothermographic material, comprising an image-forming combination of photosensitive silver halide with a silver salt of certain 1,2,4-mercaptotriazole derivatives and a phenylenediamine or aminophenol silver halide developing agent is found in this art.

There has been a need for improved photographic materials producing a dye-enhanced silver image having reduced fog when using a photosensitive silver halide with an image-forming combination comprising a silver salt of certain 1,2,4-mercaptotriazole derivatives. This need has been especially important for photothermographic materials comprising the described image-forming combination. There has also been a need for improved photothermographic materials comprising a described image-forming combination to provide a dye-enhanced silver image which enable improved post-processing image stability in the absence of a separate image stabilizer or stabilizer precursor.

SUMMARY OF THE INVENTION

It has been found according to the invention that the described advantages can be provided in a photographic material, especially a photothermographic material, for producing a dye-enhanced silver image comprising, in reactive association, (a) photosensitive silver halide, (b) an image-forming combination comprising (i) a silver salt of a 1,2,4-mercaptotriazole derivative represented by the formula:

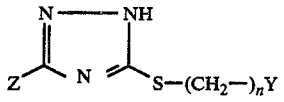

wherein Y is aryl containing 6 to 12 carbon atoms, such as phenyl, naphthyl, para-chlorophenyl, and para-methoxyphenyl; n is 0 to 2; and Z is hydrogen, hydroxyl or amine ($-NH_2$); with (ii) a phenylenediamine or aminophenol silver halide developing agent, as described herein, (c) a compound that contains a coupling moiety and which forms a dye, preferably a black dye, upon reaction with the oxidized form of the described developing agent, such as upon heating the material to a temperature above about 80° C., (d) a binder, and (e) an antifoggant concentration of a thiazoline thione antifoggant, also as described herein. Especially useful photographic materials as described are those wherein the 1,2,4-mercaptotriazole derivative is one wherein Y is phenyl, para-chlorophenyl, or para-methoxyphenyl and Z is amine ($-NH_2$) in the above formula. It has been surprisingly found that the antifoggant concentration of the thiazoline thione antifoggant not only provides desired reduction of fog in the photographic material, especially the photothermographic material, but also provides increased maximum density and increased contrast of the dye image which augments the silver image.

A developed image having reduced fog in the described photographic material, especially the photothermographic material, can be provided after imagewise exposure of the material by merely heating the exposed material at moderately elevated temperatures, such as a temperature within the range of about 125° C. to about 200° C., especially a temperature within the range of about 140° C. to about 200° C. until the desired dye and silver image is developed. Certain of the described photothermographic materials can provide not only a developed image, but also a developed image that is stable after processing and provides the desired reduced fog. Accordingly, especially useful photothermographic materials according to the invention are those that provide a developed and stabilized image having reduced fog. These especially useful materials include, for example, those described wherein Z is amine ($-NH_2$), n is 1 and Y is phenyl, para-methoxyphenyl or para-chlorophenyl.

Especially useful compounds within the photographic material that contain a coupling moiety and which form a dye upon reaction with the oxidized form of the described developing agent, such as upon heating the element to a temperature above about 80° C., are compounds that form a black dye in the photographic material. Especially useful compounds that contain such a coupling moiety are resorcinol couplers.

It has also been found according to the invention that an imaging material can be provided in which the photosensitive silver halide is omitted from the described photographic material. The latent image silver for imaging purposes can be provided in such an imaging material by other means than imagewise exposure of the material to electromagnetic radiation within the ultraviolet or visible range of the electromagnetic spectrum. Development of a dye enhanced silver image, however, can be provided by heating the exposed material to moderately elevated temperatures as described.

The photographic material and non-photographic imaging materials according to the invention can provide a dye-enhanced silver image that is typically a black image having increased maximum density and reduced fog.

DETAILED DESCRIPTION OF THE INVENTION

One embodiment of the invention is a photographic element, especially a photothermographic element, for producing a dye-enhanced silver image comprising a support having thereon, in reactive association, (a) photosensitive silver halide, (b) an image-forming combination comprising (i) a silver salt of a 1,2,4-mercaptotriazole derivative as described, with (ii) a phenylenediamine or aminophenol silver halide developing agent, (c) a compound that contains a coupling moiety and which forms a dye upon reaction with the oxidized form of the developing agent, such as upon heating the element to a temperature above about 80° C., (d) a binder, and (e) an antifoggant concentration of a thiazoline thione antifoggant, as described herein.

An especially useful silver salt in the described materials is the silver salt of 3-amino-5-benzothio-1,2,4-triazole.

Combinations of the described silver salts are also useful. The optimum combination of silver salts can be determined based on such factors as the desired image, other components in the photographic material, especially the photothermographic material, processing conditions, the particular antifoggant, and the like.

It has been found that those compounds in which Y is alkyl rather than aryl according to the described formula, provide less than desirable results in certain photothermographic materials. Specifically, the developed image has the disadvantages that a less than desired image and undesirably high fog may be obtained.

A variety of thiazoline thione antifoggants is useful in the described material, especially the photothermographic material, according to the invention. An especially useful thiazoline thione antifoggant is represented by the formula:

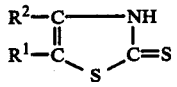

wherein $R^1$ is hydrogen, alkyl containing 1 to 10 carbon atoms, such as methyl, ethyl, propyl, butyl and decyl, aryl containing 6 to 12 carbon atoms, such as phenyl, carboxy, carboxymethyl, acetyl, carbethoxy, hydroxy, hydroxymethyl, bromohydroxyphenyl or taken with $R^2$ forms a benzo nucleus; $R^2$ is hydrogen, alkyl containing 1 to 10 carbon atoms, such as methyl, ethyl, propyl, butyl and decyl, aryl containing 6 to 12 carbon atoms, carboxy, carboxymethyl, acetyl, carbethoxy, formyl, hydroxy, hydroxymethyl, bromohydroxyphenyl or taken with $R^1$ forms a benzo nucleus. Examples of useful antifoggants, as described, include 4-carboxymethyl-4-thiazoline-2-thione, 4-hydroxymethyl-4-thiazoline-2-thione, 5-carboxy-4-methyl-4-thiazoline-2-thione and 2-mercaptobenzothiazole. Combinations of the described thiazoline thione antifoggants can also be useful in the described materials, especially photothermographic materials, according to the invention.

The selection of an optimum antifoggant concentration for a described material, especially a photothermographic material, according to the invention will depend upon such factors as the particular photographic material, the particular photosensitive silver halide, the image-forming combination, the desired image, processing conditions, the particular antifoggant and the like. The antifoggant concentration is typically within the range of about 0.005 to about 0.25 mole of the thiazoline thione antifoggant per mole of silver in the photographic material, especially the photothermographic material.

The described 1,2,4-mercaptotriazole derivatives from which the described silver salts are prepared can be prepared with procedures known in the art. For example, the preparation of 3-amino-5-benzothio-1,2,4-triazole can be carried out with the procedure described in the *Journal of the Chemical Society,* 3437 (1960) by L. Godfrey and F. Kurzer. In this preparation, for example, benzochloride (139 grams, 1.1 mole) is added dropwise to a mixture of 5-mercapto-3-amino-1,2,4-triazole (116 grams, 1 mole) with 1600 ml of ethanol, sodium hydroxide (44 grams, 1.1 mole) and 900 ml of water. The reaction mixture is heated at reflux for 6 hours. At the end of this time the ethanol is removed distillation by under reduced pressure; 1000 ml of water is added, and the solution is cooled to 5° C. The resulting product can be separated and purified using methods known in the art such as recrystallization from a suitable solvent.

The silver salt of the described 1,2,4-mercaptotriazole derivatives can be prepared by mixing a source of silver ions, such as silver trifluoroacetate or silver nitrate, with the described 1,2,4-mercaptotriazole derivative until reaction completion. Some heat may be required to solubilize the ligand unless the solutions are used in the preparation. The desired silver salt can be separated by filtration or washing or other known separation techniques. Preparation of a silver salt of the described 1,2,4-mercaptotriazole derivative is described in, for example, *Research Disclosure,* June 1977, pages 80–81, Item 15869, of P. D. Knight, R. A. deMauriac and P. A. Graham. The preparation of the silver salt 3-amino-5-benzothio-1,2,4-triazole is illustrative of the preparation of the silver salts useful in the described materials of the invention. In this preparation the silver salt is prepared in the form of a dispersion. 6.18 grams (0.03 mole) of 3-amino-5-benzothio-1,2,4-triazole and 4.0 grams of deionized photographic gelatin are dissolved with heat at 50° C. into 30 ml of a mixture of ethanol and methanol (95:5 parts volume ethanol:methanol) and 140 ml of distilled water. The resulting solution was placed in a suitable reaction vessel equipped with a rapid mixing means and then a solution of 3.4 grams (0.02 mole) of silver nitrate in 30 ml of distilled water was added rapidly at 50° C. while the solution was rapidly mixed. The reactants were mixed rapidly for 40 minutes followed by cooling to about 19° C. The resulting desired dispersion was diluted to 200 grams (10 kilograms per silver mole) with distilled water. The end dispersion had a pH of 2.8 and a pAg of 4.6.

It is also useful to prepare the described silver salts of the 1,2,4-mercaptotriazole derivatives in other compositions than in gelatin as described, such as, for example, in poly(vinyl alcohol). Other compositions can be in the form of organic solvent or aqueous solutions or the like in the absence of a polymeric vehicle. The silver salts of the 1,2,4-mercaptotriazole derivatives can be separated in their pure form and stored prior to use. However, for photographic purposes it is often useful to prepare the silver salts in the form of a dispersion. The reactants in the described preparation of the silver salts of the 1,2,4-mercaptotriazole derivatives can be mixed in stoichiometric concentrations. However, it is often desirable to mix one of the components in excess of these concentrations to insure the desired degree of reaction. Typically, for instance, the reactants are mixed to provide a molar ratio of ligand to silver ion of about 1.5. The reaction can be carried out at a temperature within the range of about 40° C. to about 80° C., typically a temperature within the range of about 50° C. to 60° C.

Preparation of the described silver salts of the 1,2,4-mercaptotriazole derivatives is usually not carried out in situ. That is, the preparation is not usually carried out in the presence of other components of the photothermographic materials described, but rather is usually carried out ex situ, that is, separate from other components of the photothermographic materials. In most instances, the preparation of the silver salts will be separate from other components of the photothermographic materials because this preparation is easier to control and provides improved storage capability.

The term "salt" is intended herein to include any type of bonding or complexing mechanism which enables the resulting material to provide imaging properties in the described materials, processes and compositions according to the invention. In some instances, the exact bonding of the described silver salt of the 1,2,4-mercaptotriazole derivative is not fully understood. Accordingly, the term "salt" is intended to include complexes and other forms of bonding which enable the desired image-forming combination to provide the desired image. The term "salt" is intended to include neutral complexes or non-neutral complexes.

The described materials, especially the photothermographic materials, according to the invention can comprise a photosensitive component which is photosensitive silver halide. The photosensitive silver halide is especially useful because it has higher photosensitivity compared to other photosensitive components. A typical concentration of photosensitive silver halide in a photographic material, especially a photothermographic material, according to the invention is within the range of about 0.05 to about 1.0 mole of photosensitive silver halide per mole of the described silver salt of the 1,2,4-mercaptotriazole derivative in the photographic material. For example, a typical concentration of photosensitive silver halide is within the range of about 0.1 to about 0.5 mole of photosensitive silver halide per mole of silver salt of the 1,2,4-mercaptotriazole derivative as described in the photographic material. Other photosensitive materials can be useful in combination with the described photosensitive silver halide if desired. Preferred photosensitive silver halides are silver chloride, silver bromide, silver bromoiodide, silver chlorobromoiodide or mixtures thereof. For purposes of the invention, silver iodide is also considered to be useful as a photosensitive silver halide; however, silver iodide is typically more difficult to stabilize after processing at desired levels than silver bromide in a photographic material according to the invention. Very fine grain photosensitive silver halide is especially useful although coarse grain silver halide can be useful. The photosensitive silver halide can be prepared by any of the procedures known in the photographic art, especially those procedures which involve the preparation of photographic silver halide gelatino emulsions. Useful procedures and forms of photosensitive silver halide for purposes of the invention are described, for example, in the *Product Licensing Index,* Volume 92, December 1971, Publication No. 9232 on page 107, published by Industrial Opportunities Ltd., Homewell, Havant Hampshire, PO9, 1EF, UK. Cubic grain silver bromoiodide, such as silver bromoiodide containing 2.5 mole percent iodide can be particularly useful. The photosensitive silver halide, as described, can be washed or unwashed, can be chemically sensitized using chemical sensitization procedures or materials known in the art, and can be mixed with the described photographic materials using procedures known in the photographic art.

The described materials, especially the photothermographic materials, can contain a variety of phenylenediamine or aminophenol silver halide developing agents. The most useful phenylenediamine or aminophenol developing agent or developing agent combination will depend upon such factors as the particular components of the photographic material, the particular photosensitive silver halide, the desired image, the particular coupler, processing temperature, and the like. The optimum developing agent, coupler, silver salt combination can be determined employing a simple test as described in following Example 1 wherein the antifoggant of Example 2 is employed. In this example the reducing agent, coupler and silver salt can be included in place of the described coupler, reducing agent and silver salt and tested as described. If the maximum and minimum densities, contrast, and fog level are at least as satisfactory as those of Example 1, the compounds are considered to be useful.

Useful aminophenol developing agents include, for example, 4-amino-2,6-dibromophenol; 4-amino-2-methylphenol sulfate; 4-amino-3-methylphenol sulfate; 4-amino-2,6-diiodophenol; 4-amino-2,6-dichlorophenol hydrochloride; and combinations thereof.

Examples of useful phenylenediamine reducing agents include: 4-amino-2-carboxy-N,N-dimethylaniline sulfate; 4-amino-3,5-dichloro-N,N-dimethylaniline; 4-amino-N,N-diethyl-3-methyl-5-sulfoaniline, potassium salt; 4-amino-3-methyl-N-ethyl-N-[$\beta$-(trimethylammonium)ethyl]aniline chloride, di-p-toluenesulfonate; 4-benzenesulfonamido-N,N-dimethylaniline and combinations thereof. An especially useful phenylenediamine silver halide developing agent consists essentially of 4-amino-2-methoxy-N,N,5-trimethylaniline sulfate.

It can be useful in some cases to use other silver halide developing agents in combination with the described phenylenediamine and aminophenol silver halide developing agents. A variety of silver halide developing agents are useful for this purpose, especially organic silver halide developing agents. These developing agents, however, must not adversely affect the silver image development and dye formation in the described materials of the invention. Combinations of certain organic silver halide developing agents can be useful. For example, a combination of a 3-pyrazolidone developing agent with an ascorbic acid developing agent can be useful. A variety of polyhydroxybenzene developing agents can be useful, such as hydroquinone, alkyl-substituted hydroquinones, including tertiarybutylhydroquinone, methylhydroquinone, 2,5-dimethylhydroquinone, and 2,6-dimethylhydroquinone; catechol and pyrogallol developing agents; chloro-substituted hydroquinone such as chlorohydroquinone or dichlorohydroquinone; alkoxy-substituted hydroquinone such as methoxyhydroquinone or ethoxyhydroquinone and the like. Other silver halide developing agents which can be useful with the phenylenediamine and aminophenol silver halide developing agents include such 3-pyrazolidone developing agents as 1-phenyl-3-pyrazolidone and 4-methyl-4-hydroxymethyl-1-phenyl-3-pyrazolidone; reductone silver halide developing agents, such as 2-hydroxy-5-methyl-3-piperidino-2-cyclopentanone; gallic acid ester reducing agents, such as methyl gallate; sulfonamidophenol developing agents such as the sulfonamidophenol developing agents described in *Research Disclosure,* January 1973, pages 16–21, published by Industrial Opportunities Ltd., Homewell, Havant Hampshire, PO9, 1EF, UK, and the like.

The term "silver halide developing agent" as employed herein is intended to include compounds which are developing agent precursors in the described photographic materials, especially in the photothermographic materials. That is, those compounds are included which are not developing agents in the photographic material until a condition occurs, such as heating of the photothermographic material.

A useful concentration of the phenylenediamine or aminophenol silver halide developing agent in a material, especially in a photothermographic material, according to the invention is typically within the range of about 0.1 mole to about 3 moles of the developing agent per mole of the silver salt of the 1,2,4-mercaptotriazole derivative as described. An especially useful concentration of phenylenediamine or aminophenol silver halide developing agent is within the range of about 0.5 to about 1.5 moles of developing agent per mole of silver salt of the 1,2,4-mercaptotriazole derivative. When a combination of developing agents is used, the total concentration of the combination is within the described ranges. The concentration of developing agent or developing agent combination must be sufficient to provide development of the silver image desired and sufficient to provide adequate oxidized developing agent to react with the compound containing the coupling moiety to provide the desired dye image. The optimum concentration of developing agent or developing agent combination can be determined based upon such factors as the desired image, other components of the photographic material, processing conditions, particular compound containing the coupling moiety and the like.

A variety of compounds that contain a coupling moiety is useful in the described material according to the invention. The compound that contains a coupling moiety must be one which forms a dye with the oxidized form of the phenylenediamine or aminophenol silver halide developing agent upon processing. That is, in a photothermographic material, for instance, the compound containing a coupling moiety must form a dye with the oxidized form of the phenylenediamine or aminophenol silver halide developing agent upon heating the element to a temperature above about 80° C. The compound containing the coupling moiety is typically colorless. The compound should also be resistant to decomposition at temperatures below those desired for dye formation. A simple test can be useful for selecting an optimum compound that contains a coupling moiety. An example of such a test is described in following Example 1. In this example the compound containing the coupling moiety to be tested is included in the photothermographic material described in place of the described coupling moiety containing compound. If the dye image produced in the resulting composition is at least as satisfactory as that of Example 1, then the compound containing the coupling moiety is considered to be useful. A compound containing a coupling moiety which provides a black dye is preferred. The term "coupling moiety," as employed herein, is intended to mean a compound or portion of a compound which in the material of the invention and under the processing conditions reacts with the oxidized form of the phenylenediamine or aminophenol silver halide developing agent to form a desired dye. The coupling moiety can be designated as a color coupler because it is believed that the compound containing the coupling moiety couple with the oxidized developing agent to provide the desired dye. The compound that contains the coupling moiety includes color-forming couplers also known as photographic dye-forming couplers. Suitable compounds that contain coupling moieties that form a dye with the oxidized form of the described developing agent include those that can withstand the processing temperatures without adversely affecting the desired sensitometric properties of the photographic material. Useful compounds that contain a coupling moiety include those described couplers that couple with the oxidized developing agent to produce a dye. While a compound containing a coupling moiety that forms a black dye is preferred, other couplers or combinations of couplers can be useful. A magenta dye-forming coupler which is useful according to the invention is 1-(2,4,6-trichlorophenyl)-3-[3-{α-(3-pentadecylphenoxy)-butyramido}benzamido]-5-pyrazolone. A useful cyan dye-forming coupler is 2,4-dichloro-1-naphthol. And, a useful yellow dye-forming coupler is α-[3-{α-(2,4-ditertiary-amylphenoxy)acetamido}benzoyl]-2-fluoroacetanilide. An especially useful dye-forming coupler in a photographic material according to the invention is a resorcinolic coupler, such as 2',6'-dihydroxytrifluoroacetanilide. Especially useful dye-forming couplers are resorcinolic couplers because they provide black dyes. Useful couplers that provide black dyes are described, for example, in copending U.S. Patent application Ser. No. 806,244 of D. A. Pupo, S. J. Ciurca, Jr., G. M. Haist and J. R. King, filed June 13, 1977, entitled Black-and-White Photographic Elements and processes. The present application Ser. No. 810,141 is commonly assigned with Ser. No. 806,244 to Eastman Kodak Company.

Combinations of compounds that contain a coupling moiety and which form a dye or dyes with the oxidized form of the described phenylenediamine or aminophenol silver halide developing agent can be useful. The combination of such compounds that contain coupling moieties can be useful together to provide a neutral (black) dye that enhances the silver image as described.

A range of concentration of compound that contains a coupler moiety is useful in the described photograhic materials according to the invention. Typically, the concentration of compound that contains a coupling moiety is within the range of about 1.0 to about 1.5 moles of the compound per mole of silver. When a combination of compounds that contain coupler moieties is used, the total concentration of the combination is within the described range. The optimum concentration of the compound that contains a coupler moiety will depend upon such factors as the particular silver halide developing agent, the desired image, other components of the photographic material, processing conditions, and the like.

The material, especially the photothermographic material, according to the invention can contain a variety of colloids and polymers alone or in combination as vehicles, binding agents and in various layers. Suitable colloids and polymers, as described, are preferably hydrophilic materials although some hydrophobic materials can be useful. The colloids and polymers are transparent or translucent and include both naturally occurring substances such as proteins, for example, gelatin, gelatin derivatives, cellulose derivatives, polysaccharides, such as dextran and the like; and synthetic polymeric materials such as hydrophilic polyvinyl compounds like poly(vinyl pyrrolidone), acrylamide polymers and the like. Other synthetic polymeric materials that can be useful include dispersed vinyl compounds such as in latex form and particularly those that increase dimensional stability of photographic materials. Effective polymers include high molecular weight materials, polymers and resins which are compatible with the described silver salt of the 1,2,4-mercaptotriazole derivatives and other components of the photographic materials according to the invention. In a photothermographic material according to the invention the polymer or combination of polymers selected must be able to withstand the processing temperatures employed without adversely affecting the desired properties of the material. Especially useful materials include gelatin, poly(vinyl pyrrolidone), and poly(vinyl alcohol). Other useful materials include copolymers of acrylamide with 1-vinylimidazole or 2-acetoacetoxyethylmethacrylate. Combinations of the described colloids and polymers can also be useful.

It is often useful to have one or more of the described polymers or colloids as an overcoat layer or layers on the described material, especially the photothermographic material, according to the invention to provide increased resistance to abrasion marks and other advantages.

It is often advantageous to include a base-release agent or base precursor in the photothermographic materials according to the invention to provide improved image development. A base-release agent or base precursor, as employed herein, is intended to include a compound or combination of compounds which upon heating in the photothermographic material to provide a more effective reaction between the described photosensitive silver halide, and the image-forming combination and provide a more useful dye enhanced silver image. Examples of useful base-release agents or base precursors are guanidinium compounds, such as guanidinium trichloroacetate and other compounds which are known to release a base moiety but do not adversely affect photographic silver halide materials.

A range of concentration of the base-release agent or base precursor is useful in the described photothermograhic materials. The optimum concentration of base-release agent or base precursor will depend upon such factors as the desired image, particular components in the photothermographic material, processing conditions, particular compound that contains a coupling moiety, and the like. A useful concentration range of base-release agent or base precursor is typically within the range of about 0.5 to about 1.5 moles of base-release agent or base precursor per mole of silver in the photothermographic material. When a combination of base-release agents or base precursors is used, the total concentration of the combination is within the described range.

The materials, especially the photothermographic materials, according to the invention, can contain an image toner to provide a more neutral or black tone image upon processing. The optimum toning agent will depend upon such factors as the particular photothermographic material, the desired image tone, particular processing conditions and the like. In some cases certain image toning agents provide better results with certain silver salts of the 1,2,4-mercaptotriazole derivatives than with other silver salts. A simple test can be useful to select an optimum image-toning agent or combination of image-toning agents. One such test comprises that described in following Example 1 in which 0.1 moles of the toning agent per mole of Ag to be tested are included in the described photothermographic material. If the tone of the resulting developed image is more neutral (black) than that of the example, the toning agent is considered to be useful. The most useful toning agent in the described test is typically that toning agent that provides the highest ratio of (a) visible maximum density to (b) blue light maximum density. When this ratio exceeds a value of about 0.9, the developed image appears neutral (black).

Selection of an especially useful toning agent or toning agent combination in a photographic material according to the invention will depend primarily on the particular components of the photographic material, however, an especially useful toning agent is one which provides a black tone image in the described photographic material. Combinations of toning agents can be useful if desired.

Some toning agents are also found to have other desired affects in the photographic material, especially the photothermographic material, such as providing development acceleration. Useful toning agents include, for example, 6-methyl-2-thiouracil and 1-phenyl-2-tetrazoline-5-thione.

A range of concentration of toning agent or toning agent combination, is useful in a material, especially a photothermographic material, according to the invention. A typically useful concentration of toning agent or toning agent combination is within the range of about 0.005 to about 0.05 mole of toning agent per mole of silver in the described material. The optimum concentration of toning agent or toning agent combination will depend upon such factors as the particular photographic material, processing conditions, desired image, the nature of the toning agent, the particular compound that contains a coupler moiety, and the like.

The photothermographic materials according to the invention do not require the presence of what is known as a melt-forming compound in order to provide a developed image. The term "melt-forming compound," as employed herein, is intended to mean a compound which upon heating to the described processing temperature provides an improved reaction medium, typically a molten medium wherein the described image-forming combination can provide a better developed image. The exact nature of the reaction medium at processing temperatures for a photothermographic material, as described, is not fully understood; however, it is believed that at the reaction temperatures a melt occurs which permits the reaction components to better interact. If desired, a melt-forming compound can be included with other components of the photothermographic material according to the invention.

An especially useful embodiment of the invention is a photographic element, preferably a photothermographic element, for producing a dye-enhanced silver image comprising a support having thereon in reactive association: (a) photosensitive silver halide, (b) an image-forming combination comprising (i) a silver salt of 3-amino-5-benzothio-1H-1,2,4-triazole, with (ii) a phenylenediamine silver halide developing agent consisting essentially of 4-amino-2-methoxy-N,N,5-trimethylaniline sulfate, (c) a dye-forming coupler consisting essentially of 2′,6′-dihydroxytrifluoroacetanilide, (d) a polymeric binder, and (e) an antifoggant concentration of 4-carboxymethyl-4-thiazoline-2-thione. The silver halide is preferably a gelatino silver bromoiodide photographic emulsion.

Another especially useful embodiment of the invention is a photographic element, preferably a photothermographic element, as described wherein the silver salt of the 1,2,4-mercaptotriazole derivative is the silver salt of 3-amino-5-(para-methoxy)benzothio-1H-1,2,4-triazole or 3-amino-5-(para-chloro)benzothio-1,2,4-triazole.

Spectral sensitizing dyes can be useful in the described photographic elements and compositions of the invention to confer additional sensitivity to these elements and compositions. Useful sensitizing dyes are described, for example, in the *Product Licensing Index*, Volume 92, December 1971, Publication No. 9232, pages 107–110, paragraph XV, published by Industrial Opportunities Ltd., Homewell, Havant Hampshire, PO9 1EF, UK. A range of spectral sensitizing dyes can be useful in the described materials. Selection of an optimum spectral sensitizing dye or dye combination will depend upon such factors as the particular photosensitive silver halide, the desired spectral sensitivity, other components of the photographic material, and the like. A preferred photographic material, especially a photothermographic material, according to the invention contains a spectral sensitizing dye selected from the group consisting of cyanine and merocyanine spectral sensitizing dyes and combinations of these dyes. Especially useful spectral sensitizing dyes include thiocarbocyanine dyes, merocyanine dyes containing a rhodanine moiety, solubilized oxacarbocyanine dyes, oxacarbocyanine dyes and merocyanine dyes containing a 2-thio-2,4-oxazolidinedione moiety.

A range of concentration of spectral sensitizing dye or dye combination is useful in the described photographic materials. Typically, the spectral sensitizing dye or dye combination concentration is within the range of about 0.5 to about 2.0 grams of spectral sensitizing dye or dye combination per mole of photosensitive silver halide.

The optimum concentration of the various components of the material, especially the photothermographic material, according to the invention will depend upon a variety of factors as described. An especially useful photothermographic material according to the invention comprises, for each mole of photosensitive silver halide, 2.0 to 8.0 moles of the described silver salt of the 1,2,4-mercaptotriazole derivative and 5.0 to 10.0 moles of the described silver halide developing agent.

The silver salt of the described 1,2,4-mercaptotriazole derivative can contain a range of ratio of the 1,2,4-mercaptotriazole moiety to the silver ion. The optimum ratio of the triazole moiety to silver ion will depend upon the particular 1,2,4-mercaptotriazole derivative, the particular photographic material, processing conditions and the like. However, the molar ratio of the 1,2,4-mercaptotriazole moiety to silver as silver ion in the described salt is usefully within the range of 0.5 to 3.0. The 1,2,4-mercaptotriazole moiety is referred to herein as the ligand. An especially useful ratio of the described 1,2,4-mercaptotriazole moiety to silver as silver ion is about 1.5.

The photothermographic materials of the invention can also contain a range of pAg. The pAg can be measured using conventional calomel and silver-silver chloride electrodes, connected to a commercial digital pH meter. The typical pAg in a dispersion containing the described components according to the invention is within the range of about 2.5 to about 7.5, with a preferred range of pAg being 4.0 to 5.0. The optimum pAg will depend upon the described factors, such as the particular photothermographic material, desired image, processing conditions and the like.

A dispersion containing the described components according to the invention typically has a pH within the range of about 1.5 to about 5.0. An especially useful pH is within the range of about 2.0 to about 4.0, preferably within the range of about 2.5 to 3.5.

The materials, especially the photothermographic materials, according to the invention can contain other addenda such as development modifiers that function as speed-increasing compounds, hardeners, plasticizers and lubricants, coating aids, brighteners, absorbing and filter dyes, antistatic materials or layers and the like. These are described, for example, in the *Product Licensing Index*, Volume 92, December 1971, Publication No. 9232, pages 107–110, published by Industrial Opportunities Ltd., Homewell, Havant Hampshire, PO9 1EF, UK.

The described components of the materials, especially the photothermographic materials, according to the invention can be in any suitable location in the materials which provides the desired image. For example, if desired, one or more of the components of the photographic element described can be in one or more layers of the element. In some cases it can be desirable to include certain percentages of the described silver halide developing agent, silver salt of the 1,2,4-mercaptotriazole derivative, the compound containing the coupling moiety, and other addenda in a protective layer over the photographic layer or in a layer between the support and the photographic layer of a photographic element as described. The components must be in a location which enables their desired interaction upon processing.

It is necessary that the photosensitive silver halide, as described, and other components in the image-forming combination as well as the compound that contains a coupling moiety be in reactive association with each other in order to provide the desired dye enhanced silver image. The term "in reactive association," as employed herein, is intended to mean that the photosensitive silver halide, the image-forming combination, and the compound containing the coupling moiety are in a location with respect to each other which enables the desired processing and provides a useful dye enhanced silver image. It is believed that the latent image formed upon imagewise exposure of the photosensitive silver halide acts as a catalyst for the image-forming combination containing the silver salt of the described 1,2,4-mercaptotriazole derivative and that the oxidized phenylenediamine or aminophenol silver halide developing agent resulting from the image-forming reaction reacts with the compound that contains the coupling moiety as described. While the exact nature of the reaction mechanisms involved and the image formation in the photographic material, especially the photothermographic material, is not fully understood, it is believed that the reaction is an amplification reaction enabled by the catalytic effect of the latent image silver. In addition, the dye formation that results provides amplification to the resulting silver image.

Another embodiment of the invention is an imaging composition or element comprising (a) an image-forming combination comprising (i) a silver salt of a 1,2,4-mercaptotriazole, as described, with (ii) a phenylenediamine or aminophenol silver halide developing agent, (c) a compound that contains a coupling moiety and which forms a dye upon reaction with the oxidized form of the developing agent, (d) a binder, such as a gelatino binder, and (e) an antifoggant concentration of a thiazoline thione antifoggant, also as described. This composition can be present, for example, as a processing composition layer or with a photosensitive silver halide element.

An especially useful imaging composition according to this embodiment comprises (a) an image-forming combination comprising (i) a silver salt of 3-amino-5-benzothio-1H-1,2,4-triazole, with (ii) a phenylenediamine silver halide developing agent consisting essentially of 4-amino-2-methoxy-N,N,5-trimethylaniline sulfate, (b) a dye-forming coupler consisting essentially of 2',6'-dihydroxytrifluoroacetanilide, (c) a polymeric binder, such as a gelatino binder, and (d) an antifoggant concentration of 4-carboxymethyl-4-thiazoline-2-thione.

If desired, other heat developable photographic materials or photothermographic materials can be useful in combination with the photographic or photothermographic materials according to the invention. The other heat developable photographic materials or photothermographic materials must be compatible with and not adversely affect the silver image formation or dye formation in a photographic material according to the invention. For example, a photothermograhic element can comprise, respectively, a support having thereon (I) a heat developable photographic layer comprising photosensitive silver halide in reactive association with an image-forming combination comprising (i) a silver salt of a 1,2,4-mercaptotriazole derivative, as described, with (ii) a phenylenediamine or aminophenol silver halide developing agent, and a compound that contains a coupling moiety, as described, with a binder and an antifoggant concentration of a thiazoline thione antifoggant, also as described, and (II) a separate layer of the element containing a different photothermographic material containing photosensitive silver halide as a component with other necessary imaging materials. The optimum concentrations and ratios of components in these layers will depend upon such factors as the desired image, particular components of the photosensitive material, processing conditions and the like.

Another embodiment of the invention is a photographic composition, especially a photothermographic composition, comprising (a) photosensitive silver halide and (b) an image-forming combination, as described, with (c) a compound that contains a coupling moiety, also as described, with an antifoggant concentration of a thiazoline thione antifoggant according to the invention.

Such a composition can be provided on a suitable support to provide a photographic element, especially a photothermographic element, according to the invention. The photographic element, especially the photothermographic element, according to the invention can comprise a variety of supports which can tolerate the processing conditions and temperatures useful according to the invention. Typical supports include cellulose ester film, poly(vinyl acetal) film, poly(ethylene terephthalate) film, polycarbonate film and polyester film supports as described, for example, in U.S. Pat. No. 3,634,089 of Hamb, issued July 11, 1972 and U.S. Pat. No. 3,725,070 of Hamb et al, issued Apr. 3, 1973. Related film and resinous support materials, as well as glass, paper, metal and the like supports which can withstand the processing temperatures described are also useful. Typically, a flexible support is most useful.

The described materials according to the invention can be coated on a suitable support by various coating procedures known in the photographic art including dip coating, airknife coating, curtain coating or extrusion coating. If desired, two or more layers can be coated simultaneously such as described in U.S. Pat. No. 2,761,791 of Russell, issued Sept. 4, 1956 and British Pat. No. 837,095 published June 9, 1960.

A variety of imagewise exposure means can be useful with the materials according to the invention. The photographic materials are typically sensitive to the ultraviolet and blue regions of the spectrum and exposure means which provide this radiation are preferred. Typically, however, if a spectral sensitizing dye or dye combination is employed in the photographic materials, exposure means using other ranges of the spectrum are applicable. Typically, a photographic element according to the invention is exposed imagewise with a visible light source, such as a tungsten lamp, although other sources of radiation are useful. Other sources of radiation which are useful include, for example, lasers, electron beams, X-ray sources and the like. The photographic materials according to the invention are typically exposed imagewise to provide a developable latent image.

A visible image can be developed in a material, especially a photothermographic material, as described, within a short time. In a photographic material, a conventional processing means can be useful for developing the dye and silver images. In the case of a photothermographic material, the latent image can be developed within a short time, such as within several seconds, merely by uniformly heating the exposed photothermographic material to moderately elevated temperatures. For example, the exposed photothermographic material can be heated uniformly to a temperature within the range of about 125° C. to about 200° C., typically a temperature within the range of about 150° C. to about 180° C. Heating is carried out until a desired image is developed, typically within about 1 to 60 seconds, such as within about 1 to about 30 seconds. At the lower processing temperatures, such as at about 125° C., development of an image requires a longer processing time. However, at the lower processing temperature, such as below about 140° C., a sufficient degree of post-processing stabilization may not be observed with the described photothermographic materials that contain the preferred silver salts as described.

Another embodiment of the invention is a process of developing a dye enhanced silver image in an exposed photographic material, especially a photothermographic material, as described containing the preferred silver salts of the 1,2,4-mercaptotriazole derivatives comprising heating the photographic material to a temperature within the range of about 125° C. to about 200° C., preferably to a temperature within the range of about 140° C. to about 200° C., until an image is developed.

Although it is often undesirable, due to the lack of control in preparation, all or a portion of the described photosensitive silver halide can be prepared in situ in the described photographic material, especially the photothermographic material, according to the invention. Such a method of preparation of photosensitive silver halide in situ in a photothermographic material is described, for example, in U.S. Pat. No. 3,457,075 of Morgan et al, issued July 22, 1969.

Processing according to the invention is usually carried out under ambient conditions of pressure and humidity. Pressures and humidity outside normal atmospheric conditions can be employed if desired; however, normal atmospheric conditions are preferred.

A variety of means can be useful to provide the necessary heating of the described photothermographic materials to provide a developed dye enhanced silver image. The heating means can be a simple hot plate, iron, roller or the like.

The following examples are included for a further understanding of the invention.

EXAMPLE 1

This is a comparative example.

The silver salt of 3-amino-5-benzothio-1H-1,2,4-triazole was prepared as follows: 3-amino-5-benzothio-1H-1,2,4-triazole (45 grams) (referred to herein as ABT) was dissolved in 90 ml of 20% by weight aqueous ethanol and combined with 15 ml of 10% by weight aqueous gelatin. The resulting mixture was adjusted to a pH of 2.8 and then mixed thoroughly in a blender. After several minutes, a 0.3 molar aqueous solution (44 ml) of silver nitrate was added to the mixture in the blender. The final mixture was blended for 40 minutes at 43.3° C. and then combined with 1.5 grams of gelatin and adjusted to a pH of 2.8.

The described silver salt dispersion was combined with the following materials and coated on a poly(ethylene terephthalate) film support at the indicated coverages:

| | | |
|---|---|---|
| silver salt dispersion of ABT (prepared as described above) | 0.97 | grams of silver per square meter |
| silver bromoiodide gelatino emulsion (3 mole % of iodide, 0.793 kilograms per mole of silver, 40 grams of gelatin per mole of silver) | 0.22 | grams of silver per square meter |
| 4-amino-2-methoxy-N,N,5-trimethylaniline sulfate | 1.01 | grams per square meter |
| 2', 6'-dihydroxytrifluoroacetanilide | 2.38 | grams per square meter |
| gelatin (binder) | 0.87 | grams per square meter |
| surfactant (Surfactant 10G, a polyglycidol surfactant, available from the Olin Corp., U.S.A.) | 0.013 | grams per square meter |

The resulting composition was coated on a poly(ethylene terephthalate) film support at a wet coating thickness of 4 mil and then dried. The resulting photothermographic material was imagewise exposed for $10^{-3}$ seconds to tungsten light through a graduated density step wedge with a 1.2 neutral density filter to provide a developable latent image in the element. The resulting latent image was developed by overall heating the photothermographic element at 160° C. for 45 seconds. The resulting element provided an undesirably fogged image.

EXAMPLE 2

The procedure described in Example 1 was repeated with the exception that the final composition also contained 0.1 mole of 4-carboxymethyl-4-thiazoline-2-thione per mole of silver. The resulting photothermographic element was imagewise exposed as described in Example 1 to provide a developable latent image and then processed by heating, also as described in Example 1. The exposed and processed coating provided a developed image having a maximum density of 1.9 and a minimum density of 0.20. The resulting developed image was not undesirably fogged.

EXAMPLE 3

The procedure described in Example 1 was repeated with the exception that 0.1 mole of 4-methyl-4-thiazoline-2-thione was added to the final composition prior to coating on the described film support. The resulting developed image upon processing, as described in Example 1, had a minimum density of 0.16 and a maximum density of 1.2. However, the resulting developed image was not as satisfactory as that of Example 2.

EXAMPLE 4

The procedure described in Example 1 was repeated with the exception that 0.1 mole of 4-hydroxymethyl-4-thiazoline-2-thione was added to the final composition prior to coating on the described film support. The resulting developed image had a maximum density of 1.7 and a minimum density of 0.16. The developed image did not have undesired fog.

EXAMPLE 5

The procedure described in Example 1 was repeated wit the exception that 0.02 mole of 5-carboxy-4-methyl-4-thiazoline-2-thione was added to the final composition prior to coating on the described film support. The resulting developed image had a maximum density of 1.7 and a minimum density of 0.20. The image did not have undesired fog.

EXAMPLE 6

The procedure described in Example 1 was repeated with the exception that 0.1 mole of 2-mercaptobenzothiazole was added to the final composition prior to coating on the described film support. The resulting developed image had a maximum density of 2.3 and a minimum density of 0.35. The developed image did not have undesired fog.

EXAMPLE 7

The procedure described in Example 1 was repeated with the exception that 0.1 mole of 4-formyl-4-thiazoline-2-thione was added to the final composition prior to coating on the described film support. The resulting developed image had a maximum density of 1.2 and a minimum density of 0.18. The developed image was not as satisfactory as the image in Example 2.

EXAMPLE 8

This is a comparative example.

The procedures described in Examples 1 (no antifoggant) and 2 (0.1 mole of antifoggant) were repeated with the described photothermographic elements, exposure and development (15 seconds at 180° C.) with the exception that the compounds listed in following Table I were added to the photothermographic composition at 0.1 mole of compound. The results obtained are given in Table I.

Table I

| Element | Compound | D-max | D-min | Image Tone |
|---|---|---|---|---|
| 8A | Control (none) | 2.3 | 0.70 | Neutral |
| 8B | Phenylmercaptotetrazole (comparative example) | 1.8 | 0.73 | Bluish |
| 8C | 4-Hydroxy-6-methyl-tetraazaindene, Na salt (comparative example) | 2.1 | 1.1 | Neutral |
| 8D | 5-Methylbenzotriazole (comparative example) | 1.5 | 0.5 | Bluish |
| 8E | 4-Carboxymethyl-4-thiazoline-2-thione (invention) | 1.9 | 0.25 | Neutral |

Thus, it is clear that element 8E, which contains the currently preferred antifoggant, provided both a low D-min and maintained neutral image tone. These advantages were not observed in elements 8B, 8C and 8D, due to unacceptably high D-min and non-neutral image tone in 8B and 8D.

The invention has been described in detail with particular reference to preferred embodiments thereof, but it will be understood that variations and modifications can be effected within the spirit and scope of the invention.

What is claimed is:

1. A photographic element for producing a dye enhanced silver image comprising a support having thereon, in reactive association, (a) photosensitive silver halide, (b) an image-forming combination comprising (i) a silver salt of a 1,2,4-mercaptotriazole represented by the formula:

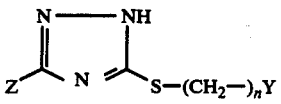

wherein Y is aryl containing 6 to 12 carbon atoms; n is 0 to 2; and Z is hydrogen, hydroxyl or $-NH_2$; with (ii) a phenylenediamine or aminophenol silver halide developing agent, (c) a compound that contains a coupling moiety and which forms a dye upon reaction with the oxidized form of said developing agent, (d) a binder, and (e) an antifoggant concentration of a thiazoline thione antifoggant.

2. A photographic element as in claim 1 wherein said thiazoline thione antifoggant is represented by the formula:

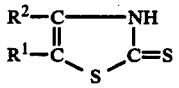

wherein $R^1$ is hydrogen, alkyl containing 1 to 10 carbon atoms, aryl containing 6 to 12 carbon atoms, carboxy, carboxymethyl, acetyl, carbethoxy, hydroxy, hydroxymethyl, bromohydroxyphenyl or taken with $R^2$ forms a benzo nucleus; $R^2$ is hydrogen, alkyl containing 1 to 10 carbon atoms, aryl containing 6 to 12 carbon atoms, carboxy, carboxymethyl, acetyl, carbethoxy, formyl, hydroxy, hydroxymethyl, bromohydroxyphenyl or taken with $R^1$ forms a benzo nucleus.

3. A photographic element as in claim 1 wherein said antifoggant concentration is within the range of 0.005 to 0.25 mole of said thiazoline thione antifoggant per mole of silver in said element.

4. A photographic element as in claim 1 wherein the silver salt of the 1,2,4-mercaptotriazole has a molar ratio of the mercaptotriazole to silver ion within the range of 0.5 to 3.0.

5. A photographic element as in claim 1 comprising, for each mole of photosensitive silver halide, 2.0 to 8.0 moles of said silver salt of the 1,2,4-mercaptotriazole, and 5.0 to 10.0 moles of said silver halide developing agent.

6. A photographic element as in claim 1 wherein said compound that contains a coupling moiety is a resorcinol coupler.

7. A photographic element as in claim 1 wherein said compound that contains a coupling moiety is 2',6'-dihydroxytrifluoroacetanilide.

8. A photographic element as in claim 1 also comprising a base precursor.

9. A photographic element as in claim 1 also comprising a base precursor consisting essentially of a guanidinium salt.

10. A photographic element as in claim 1 also comprising an image toner.

11. A photographic element as in claim 1 also comprising an image toner consisting essentially of a 1-phenyl-2-tetrazoline-5-thione compound.

12. A photographic element as in claim 1 wherein said thiazoline thione antifoggant is a compound selected from the group consisting of 4-carboxymethyl-4-thiazoline-2-thione, 4-hydroxymethyl-4-thiazoline-2-thione, 5-carboxy-4-methyl-4-thiazoline-2-thione, 2-mercaptobenzothiazole, and combinations thereof.

13. A photographic element for producing a dye enhanced silver image comprising a support having thereon in reactive association:

(a) photosensitive silver halide, (b) an image-forming combination comprising (i) a silver salt of 3-amino-5-benzylthio-1H-1,2,4-triazole, with (ii) a phenylenediamine silver halide developing agent consisting essentially of 4-amino-2-methoxy-N,N,5-trimethylaniline sulfate, (c) a dye forming coupler consisting essentially of 2',6'-dihydroxytrifluoroacetanilide, (d) a polymeric binder, and (e) an antifoggant concentration of 4-carboxymethyl-4-thiazoline-2-thione.

14. A photographic element as in claim 13 wherein said photosensitive silver halide is a gelatino silver bromoiodide photographic emulsion.

15. A photothermographic element for producing a dye enhanced silver image comprising a support having thereon, in reactive association, (a) photosensitive silver halide, (b) an image-forming combination comprising (i) a silver salt of a 1,2,4-mercaptotriazole represented by the formula:

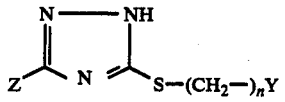

wherein Y is aryl containing 6 to 12 carbon atoms; n is 0 to 2; and Z is hydrogen, hydroxyl or $-NH_2$; with (ii) a phenylenediamine or aminophenol silver halide developing agent, (c) a compound that contains a coupling moiety and which forms a dye with the oxidized form of said developing agent upon heating said element to a temperature above about 80° C., (d) a binder, and (e) an antifoggant concentration of a thiazoline thione antifoggant.

16. A photothermographic element as in claim 15 wherein said thiazoline thione antifoggant is represented by the formula:

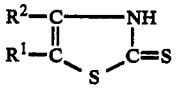

wherein $R^1$ is hydrogen, alkyl containing 1 to 10 carbon atoms, aryl containing 6 to 12 carbon atoms, carboxy, carboxymethyl, acetyl, carbethoxy, hydroxy, hydroxymethyl, bromohydroxyphenyl or taken with $R^2$ forms a benzo nucleus; $R^2$ is hydrogen, alkyl containing 1 to 10 carbon atoms, aryl containing 6 to 12 carbon atoms, carboxy, carboxymethyl, acetyl, carbethoxy, formyl, hydroxy, hydroxymethyl, bromohydroxyphenyl or taken with $R^1$ forms a benzo nucleus.

17. A photothermographic element as in claim 15 wherein said antifoggant concentration is within the range of 0.005 to 0.25 mole of said thiazoline thione antifoggant per mole of silver in said element.

18. A photothermographic element as in claim 15 wherein the silver salt of the 1,2,4-mercaptotriazole has a molar ratio of the mercaptotriazole to silver ion within the range of 0.5 to 3.0.

19. A photothermographic element as in claim 15 comprising, for each mole of photosensitive silver halide, 2.0 to 8.0 moles of said silver salt of the 1,2,4-mercaptotriazole, and 5.0 to 10.0 moles of said silver halide developing agent.

20. A photothermographic element as in claim 15 wherein said compound that contains a coupling moiety is a resorcinol coupler.

21. A photothermographic element as in claim 15 wherein said compound that contains a coupling moiety is 2',6'-dihydroxytrifluoroacetanilide.

22. A photothermographic element as in claim 15 also comprising a base precursor.

23. A photothermographic element as in claim 15 also comprising a base precursor consisting essentially of a guanidinium salt.

24. A photothermographic element as in claim 15 also comprising an image toner.

25. A photothermographic element as in claim 15 also comprising an image toner consisting essentially of a 1-phenyl-2-tetrazoline-5-thione compound.

26. A photothermographic element as in claim 15 wherein said thiazoline thione antifoggant is a compound selected from the group consisting of 4-carboxymethyl-4-thiazoline-2-thione, 4-hydroxymethyl-4-thiazoline-2-thione, 5-carboxy-4-methyl-4-thiazoline-2-thione, 2-mercaptobenzothiazole, and combinations thereof.

27. A photothermographic element for producing a dye enhanced silver image comprising a support having thereon in reactive association:

(a) photosensitive silver halide, (b) an image-forming combination comprising (i) a silver salt of 3-amino-5-benzylthio-1H-1,2,4-triazole, with (ii) a phenylenediamine silver halide developing agent consisting essentially of 4-amino-2-methoxy-N,N,5-trimethylaniline sulfate, (c) a dye forming coupler consisting essentially of 2',6'-dihydroxytrifluoroacetanilide, (d) a polymeric binder, and (e) an antifoggant concentration of 4-carboxymethyl-4-thiazoline-2-thione.

28. A photothermographic element as in claim 27 wherein said photosensitive silver halide is a gelatino silver bromoiodide photographic emulsion.

29. A photographic composition comprising (a) photosensitive silver halide, (b) an image-forming combination comprising (i) a silver salt of a 1,2,4-mercaptotriazole represented by the formula:

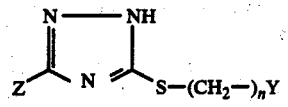

wherein Y is aryl containing 6 to 12 carbon atoms; n is 0 to 2; and Z is hydrogen, hydroxyl or $-NH_2$; with (ii) a phenylenediamine or aminophenol silver halide developing agent, (c) a compound that contains a coupling moiety and which forms a dye upon reaction with the oxidized form of said developing agent, (d) a binder, and (e) an antifoggant concentration of a thiazoline thione antifoggant.

30. A photographic composition as in claim 29 wherein said thiazoline thione antifoggant is represented by the formula:

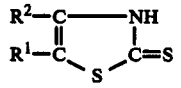

wherein $R^1$ is hydrogen, alkyl containing 1 to 10 carbon atoms, aryl containing 6 to 12 carbon atoms, carboxy, carboxymethyl, acetyl, carbethoxy, hydroxy, hydroxymethyl, bromohydroxyphenyl or taken with $R^2$ forms a benzo nucleus; $R^2$ is hydrogen, alkyl containing 1 to 10 carbon atoms, aryl containing 6 to 12 carbon atoms, carboxy, carboxymethyl, acetyl, carbethoxy, formyl, hydroxy, hydroxymethyl, bromohydroxyphenyl or taken with $R^1$ forms a benzo nucleus.

31. A photographic composition as in claim 29 wherein said antifoggant concentration is within the range of 0.005 to 0.25 mole of said thiazoline thione antifoggant per mole of silver in said composition.

32. A photographic composition as in claim 29 wherein the silver salt of the 1,2,4-mercaptotriazole has a molar ratio of the mercaptotriazole to silver ion within the range of 0.5 to 3.0.

33. A photographic composition as in claim 29 comprising, for each mole of photosensitive silver halide, 2.0 to 8.0 moles of said silver salt of the 1,2,4-mercaptotriazole, and 5.0 to 10.0 moles of said silver halide developing agent.

34. A photographic composition as in claim 29 wherein said compound that contains a coupling moiety is a resorcinol coupler.

35. A photographic composition as in claim 29 wherein said compound that contains a coupling moiety is 2',6'-dihydroxytrifluoroacetanilide.

36. A photographic composition as in claim 29 also comprising a base precursor.

37. A photographic composition as in claim 29 also comprising a base precursor consisting essentially of a guanidinium salt.

38. A photographic composition as in claim 29 also comprising an image toner.

39. A photographic composition as in claim 29 also comprising an image toner consisting essentially of a 1-phenyl-2-tetrazoline-5-thione compound.

40. A photographic composition as in claim 29 wherein said thiazoline thione antifoggant is a compound selected from the group consisting of 4-carboxymethyl-4-thiazoline-2-thione, 4-hydroxymethyl-4-thiazoline-2-thione, 5-carboxy-4-methyl-4-thiazoline-2-thione, 2-mercaptobenzothiazole, and combinations thereof.

41. A photographic composition comprising (a) photosensitive silver halide, (b) an image-forming combination comprising (i) a silver salt of 3-amino-5-benzylthio-1H-1,2,4-triazole, with (ii) a phenylenediamine silver halide developing agent consisting essentially of 4-amino-2-methoxy-N,N,5-trimethylaniline sulfate, (c) a dye forming coupler consisting essentially of 2′,6′-dihydroxytrifluoroacetanilide, (d) a polymeric binder, and (e) an antifoggant concentration of 4-carboxymethyl-4-thiazoline-2-thione.

42. A photographic composition as in claim 41 wherein said photosensitive silver halide is a gelatino silver bromoiodide photographic emulsion.

43. A process of developing an image in an imagewise exposed photothermographic element comprising a support having thereon, in reactive association, (a) photosensitive silver halide, (b) an image-forming combination comprising (i) a silver salt of a 1,2,4-mercaptotriazole represented by the formula:

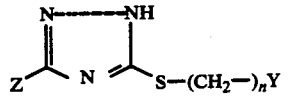

wherein Y is aryl containing 6 to 12 carbon atoms; n is 0 to 2; and Z is hydrogen, hydroxyl or $—NH_2$; with (ii) a phenylenediamine or aminophenol silver halide developing agent, (c) a compound that contains a coupling moiety and which forms a dye with the oxidized form of said developing agent upon heating said element to a temperature above about 80° C., (d) a binder, and (e) an antifoggant concentration of a thiazoline thione antifoggant, comprising heating said element to a temperature within the range of 125° C. to 200° C. until said image is developed.

44. A process of developing an image in an imagewise exposed photothermographic element comprising a support having thereon, in reactive association, (a) photosensitive silver halide, (b) an image-forming combination comprising (i) a silver salt of 3-amino-5-benzylthio-1H-1,2,4-triazole, with (ii) a phenylenediamine silver halide developing agent consisting essentially of 4-amino-2-methoxy-N,N,5-trimethylaniline sulfate, (c) a dye forming coupler consisting essentially of 2′,6′-dihydroxytrifluoroacetanilide, (d) a polymeric binder, and (e) an antifoggant concentration of 4-carboxymethyl-4-thiazoline-2-thione, comprising heating said element to a temperature within the range of 125° C. to 200° C. until said image is developed.

* * * * *

UNITED STATES PATENT AND TRADEMARK OFFICE

CERTIFICATE OF CORRECTION

PATENT NO. : 4,138,265

DATED : February 6, 1979

INVENTOR(S) : Daniel D. Shiao

It is certified that error appears in the above-identified patent and that said Letters Patent are hereby corrected as shown below:

Column 1, line 47, "or" should read ---of---.

Column 5, lines 66-67, "distillation by" should read ---by distillation---.

Column 10, line 17, "processes" should read ---Processes---; line 28, "photograhic" should read ---photographic---.

Column 18, line 15, "wit" should read ---with---.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*